US009160101B2

(12) United States Patent
Takane

(10) Patent No.: US 9,160,101 B2
(45) Date of Patent: Oct. 13, 2015

(54) ELECTRIC CONNECTOR

(71) Applicant: IRISO ELECTRONICS CO., LTD., Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/458,497

(22) Filed: Aug. 13, 2014

(65) Prior Publication Data

US 2015/0056844 A1 Feb. 26, 2015

(30) Foreign Application Priority Data

Aug. 21, 2013 (JP) ..... 2013-171229

(51) Int. Cl.

| | |
|---|---|
| ***H01R 13/15*** | (2006.01) |
| ***H01R 13/62*** | (2006.01) |
| ***H01R 12/79*** | (2011.01) |
| ***H01R 12/88*** | (2011.01) |
| ***H01R 12/77*** | (2011.01) |

(52) U.S. Cl.

CPC ..... *H01R 13/62* (2013.01); *H01R 12/774* (2013.01); *H01R 12/79* (2013.01); *H01R 12/88* (2013.01)

(58) Field of Classification Search

CPC ..... H01R 12/88
USPC ..... 439/260, 495
See application file for complete search history.

(56) References Cited

U.S. PATENT DOCUMENTS

| | | | | |
|---|---|---|---|---|
| 7,553,183 | B2 * | 6/2009 | Taketomi et al. | 439/495 |
| 7,909,630 | B2 * | 3/2011 | Yamada | 439/260 |
| 8,128,425 | B2 * | 3/2012 | Takahashi et al. | 439/260 |
| 2004/0002254 | A1 | 1/2004 | Tsunematsu | |
| 2009/0298355 | A1 | 12/2009 | Yamada | |
| 2011/0117765 | A1 | 5/2011 | Takahashi et al. | |
| 2011/0237106 | A1 | 9/2011 | Wada et al. | |

FOREIGN PATENT DOCUMENTS

| | | |
|---|---|---|
| JP | 2006-147157 A | 6/2006 |
| JP | 2009-158279 A | 7/2009 |

(Continued)

OTHER PUBLICATIONS

European Search Report for European Patent App. No. 14180609.1 (Sep. 24, 2014).

(Continued)

*Primary Examiner* — Tho D Ta

(74) *Attorney, Agent, or Firm* — Cermak Nakajima & McGowan LLP; Tomoko Nakajima

(57) ABSTRACT

An electric connector including a housing having an insertion opening for a flat conductor, a connector terminal that is conductively connected to the flat conductor, an actuator having a pressing surface, and a shaft portion. The connector terminal is provided with a terminal portion that comes in contact with the flat conductor and a base end that supports the terminal portion. The terminal portion is provided with a front terminal that includes a front contact portion that is provided on an insertion opening side with respect to the shaft portion so as to face the pressing surface and a rear terminal that includes a rear contact portion that is provided on the rear side of the housing with respect to the pressing surface and at a position that is closer to the pressing surface with respect to the front contact portion.

8 Claims, 8 Drawing Sheets

(56) References Cited

FOREIGN PATENT DOCUMENTS

| | | | |
|---|---|---|---|
| JP | 4372224 | B1 | 9/2009 |
| JP | 2009-252588 | A | 10/2009 |
| JP | 2009-289508 | A | 12/2009 |
| JP | 2010-040309 | A | 2/2010 |
| JP | 2010-257676 | A | 11/2010 |
| JP | 4568791 | B1 | 6/2011 |
| JP | 2012-049029 | A | 3/2012 |
| JP | 2013-004199 | A | 1/2013 |
| KR | 10-2004-0004053 | A | 1/2004 |
| WO | WO2012/172984 | A1 | 12/2012 |

OTHER PUBLICATIONS

Office Action from Korean Patent App. No. 10-2014-0104878 (Aug. 28, 2014).

Notice of Reasons for Rejection for Japanese Patent App. No. 2013-171229 (Mar. 11, 2014) with certified English language translation thereof.

* cited by examiner

ELECTRIC CONNECTOR

BACKGROUND OF THE INVENTION

1. Field of the Invention

The present invention relates to an electric connector that conductively connects a flat conductor to a printed board.

2. Description of the Related Art

An electric connector such as a flexible printed circuit (FPC) or a flexible flat cable (FFC) that conductively connects a flat conductor and a printed board to each other is typically used. As such an electric connector, an electric connector is known that includes a plurality of terminals that have connection portions that come in contact with a flat conductor and that press the flat conductor against the terminals by pivoting an actuator (see Japanese Unexamined Patent Application Publication No. 2009-158279, for example).

The above electric connector includes front terminals that are positioned on the flat conductor insertion opening side with respect to the shaft portion of the actuator and rear terminals that are positioned on the rear side of the flat conductor with respect to the shaft portion of the actuator. Moreover, rear contact portions that are provided in the rear terminals are disposed above (on a pressing surface side of the actuator) front contact portions provided in the front terminals and the front contact portions and the rear contact portions are provided at positions facing the pressing surface of the actuator when the flat conductor is in a fitted state. In the above case, the pressing surface of the actuator is fixed so as to be inclined in the closing direction of the actuator along an inclination connecting the rear contact portions and the front contact portions. With the above configuration, the actuator is not easily pivoted in the opening direction and the flat conductor and the electric connector connected together are not easily released from each other.

However, in the electric connector described above in which the rear terminals are positioned on the rear side with respect to the shaft portion and in which the rear terminals are disposed at a position facing the pressing surface of the actuator, upon inclination of the pressing surface of the actuator in the closing direction, the flat conductor becomes inclined in the closing direction of the actuator in a similar manner. Furthermore, the rear terminals apply a force to the actuator in the closing direction such that the inclination in the closing direction of the actuator is strongly maintained. Accordingly, there are cases in which a portion of the flat conductor that is exposed to the outside of the electric connector comes in contact with the printed board causing unintended conductive connection, and thus disadvantageously requiring additional insulation measures to be implemented.

SUMMARY OF THE INVENTION

The present invention has been made to overcome the above shortcomings. In other words, an object of the invention is to provide an electric connector that can, without exerting any pressing force that biases the actuator in the closing direction, make it difficult for the electric connector and the flat conductor fitted together to be released from each other.

In order to achieve the object described above, the present invention is configured as below.

That is to say, an electric connector is provided including a housing including an insertion opening for a flat conductor, a connector terminal that is conductively connected to the flat conductor, an actuator including a pressing surface that presses the flat conductor against the connector terminal by a pivoting motion, and a shaft portion that serves as a central axis of the pivoting motion. The connector terminal includes a terminal portion that comes in contact with the flat conductor and a base end that supports the terminal portion at a position on a rear side of the housing in a short direction. The terminal portion includes a front terminal that includes a front contact portion that is provided on an insertion opening side with respect to the shaft portion and at a position facing the pressing surface, and a rear terminal that includes a rear contact portion that is provided on the rear side of the housing in the short direction with respect to the pressing surface and at a position on the upper side of the housing with respect to the front contact portion.

Since the terminal portion includes the front terminal that has the front contact portion and the rear terminal that has the rear contact portion, even if, for example, there is a contact failure between one of the terminals and the flat conductor, the other terminal can be in contact with the flat conductor; accordingly, conductive connection can be established in a reliable manner. Furthermore, the displacement of the rear contact portion disposed on the rear side of the housing can be made large by providing the rear contact portion at a position on the upper side of the housing with respect to the front contact portion; accordingly, contact pressure of the rear terminal can be increased and contact with the flat conductor can be established in a reliable manner.

Furthermore, by providing the front contact portion that is positioned on the insert opening side with respect to the shaft portion at a position facing the pressing surface, the flat conductor can be pressed against the pressing surface and the flat conductor can be held between the front contact portion and the pressing surface. Moreover, since the rear contact portion is disposed on the rear side of the housing in the short direction with respect to the pressing surface, the contact pressure of the rear terminal does not directly act on the pressing surface of the flat conductor. Accordingly, the rear terminal can be in contact with the flat conductor in a reliable manner without the rear terminal, which is fitted with the flat conductor, directly applying a pressing force to the actuator in both the closing direction and the opening direction.

The rear terminal of the present invention may be connected to the base end at a position on the rear side of the housing in the short direction with respect to the insertion end of the flat conductor in the fitted state.

Accordingly, the length of the rear terminal can be set long and the displacement of the rear terminal in the direction in which the pressing surface presses the flat conductor can be increased. Accordingly, the contact pressure of the rear terminal can be increased and the connection reliability on the flat conductor can be improved.

The front terminal of the present invention may be connected to the base end at a position on the rear side of the housing in the short direction with respect to the insertion end of the flat conductor in the fitted state.

With such a configuration, since the length of the front terminal can be set long, the displacement of the front terminal in the direction in which the pressing surface presses the flat conductor can be increased. Accordingly, the contact pressure of the front terminal can be increased and the connection reliability on the flat conductor can be improved.

The rear terminal of the present invention may be connected to the base end at a position on the upper side of the housing with respect to the insertion end of the flat conductor in the fitted state.

When the rear terminal is, with respect to the insertion end of the flat conductor in the fitted state, connected to the base end at a position on the pressing surface side in the direction in which the pressing surface presses the flat conductor, the rear terminal that extends from the base end extends around to the side of the flat conductor opposite the pressing surface side and comes in contact with the flat conductor. Accordingly, the length of the rear terminal can be made long and the rear terminal can be one that is bent easily and that is not easily damaged.

The front terminal of the present invention may be inclined towards the pressing surface side from the base end side to the distal end side.

With such a configuration, a large space can be provided between the distal end side of the front terminal and the bottom portion of the housing; accordingly, a large space in which the front contact portion of the front terminal is displaced can be obtained. Accordingly, when the front terminal is pressed by the flat conductor, the front terminal can be displaced in a greater manner and the contact pressure can be increased, and thus, the contact reliability on the flat conductor can be improved. Furthermore, since a large space can be provided between the base end side of the front terminal and the base end side of the rear terminal as well, the rear terminal can be prevented from coming in contact with the front terminal when the rear terminal is displaced.

The contact pressure of the rear terminal of the present invention may be set higher than the contact pressure of the front terminal.

With such a configuration, the rear contact portion that is positioned on the rear side with respect to the front contact portion can be in contact with the flat conductor in a reliable manner. Furthermore, upon pivoting of the actuator, the flat conductor first comes in contact with the rear terminal and then comes in contact with the front terminal. If the contact pressure of the front terminal is higher than the contact pressure of the rear terminal, in order to displace the front terminal, the actuator needs to be pivoted with a stronger force compared to a case in which the rear terminal is displaced. Accordingly, an operator may feel a reactive force in the hands when the flat conductor comes in contact with the front terminal, which may make the operator erroneously perceive that the fitting process of the flat conductor has been completed and may make the operator stop the pivoting operation.

Therefore, the contact pressure of the rear terminal is set higher than the contact pressure of the front terminal so that the momentum of the pivoting actuator that has displaced the rear terminal displaces the front terminal; accordingly, fitting process of the flat conductor can be completed in a reliable manner.

The pressing surface of the present invention may be provided in parallel to the printed board on which the housing is mounted when the flat conductor is in the fitted state.

With such a configuration, since the flat conductor and the printed board can be maintained parallel to each other, a portion of the flat conductor that is exposed to the outside of the electric connector can be prevented from coming in contact with the printed board.

The terminal portion of the present invention may extend from a position on the rear side of the housing towards the insertion opening.

When a cantilever-shaped terminal portion is formed such that the base end thereof is provided on the insertion opening side and such that the front contact portion and the rear contact portion that are free ends are provided on the rear side of the housing, because each of the contact portions come in contact with the flat conductor at the rear side of the housing, each of the effective fitting lengths to the flat conductor (the fitting lengths from the insertion end of the flat conductor to the contact of the front contact portion and to the contact of the rear contact portion) becomes disadvantageously short.

In such a case, the pressing surface of the actuator and the terminal portion press only the insertion end side of the flat conductor; accordingly, there are cases in which the portion of the insertion opening side that is not pressed is bent by its own weight and is inclined towards the closing direction of the actuator such that the likelihood of the flat conductor coming in contact with the printed board is increased.

Accordingly, in the present invention, the base end of a cantilever-shaped terminal portion is provided on the rear side of the housing and each of the contacts are provided on the insertion opening side. Since the contacts come in contact with the flat conductor on the insertion opening side of the housing, the flat conductor is more less likely to incline in the closing direction of the actuator.

The pressing surface of the present invention may be provided so as to incline upward from the rear side of the housing in the short direction towards the insertion opening side when the flat conductor is in the fitted state.

With such a configuration, the flat conductor may be maintained at an inclined state from the rear side of the housing in the short direction towards the insertion opening side; accordingly, the flat conductor can be prevented from coming in contact with the printed board in a more reliable manner.

According to the present invention, the front contact portion and the rear contact portion can be conductively connected to the flat conductor in a reliable manner. In particular, by providing the rear contact portion closer to the pressing surface of the actuator with respect to the front contact portion, the contact pressure of the rear terminal can be increased. Moreover, since the contact pressure of the rear terminal does not directly act on the pressing surface of the actuator and since the actuator do not pivot in the opening direction or the closing direction, the rear terminal and the flat conductor can be maintained in a fitted state in a reliable manner.

DESCRIPTION OF THE PREFERRED EMBODIMENTS

Figure 1:
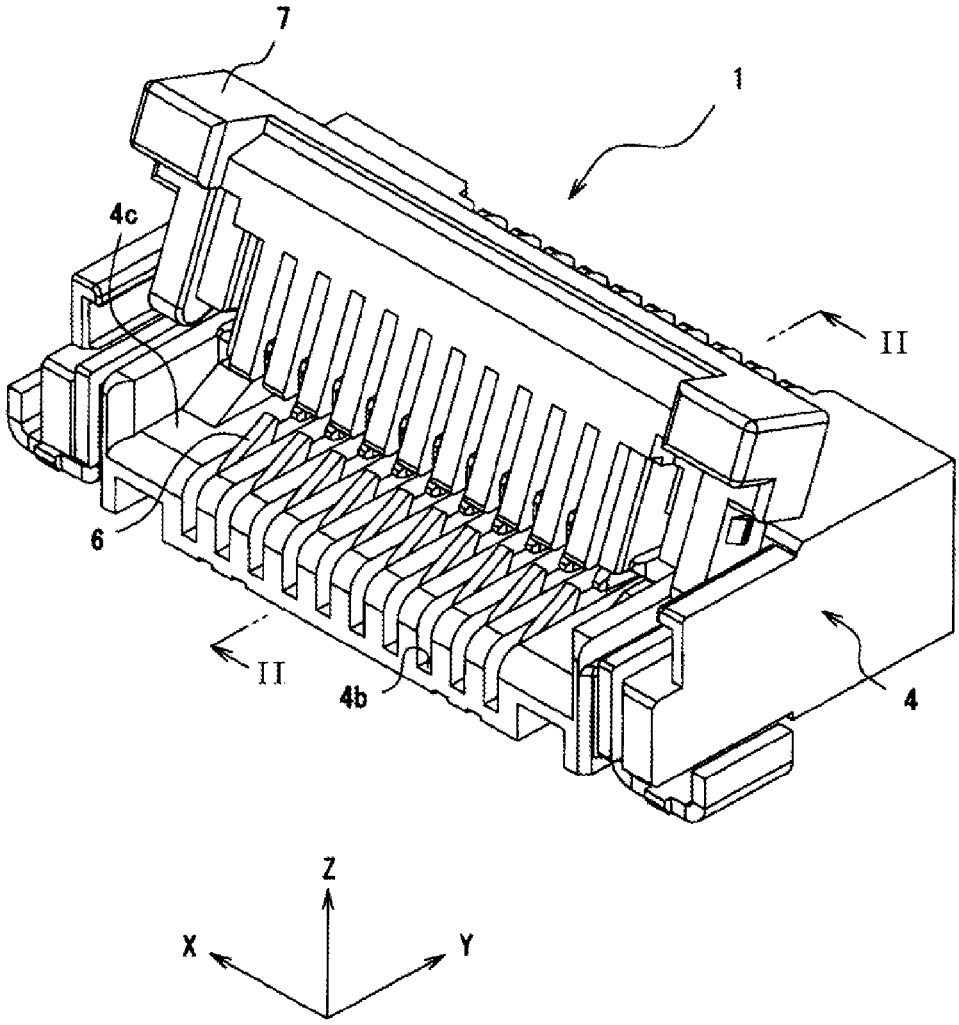
FIG. 1 is a perspective view illustrating an electric connector of a first embodiment.

Hereinafter, preferred embodiments of the present invention will be described with reference to the drawings. Components that are common among each of the embodiments below will be denoted with the same reference numerals and repetitive description will be omitted.

First Embodiment

FIGS. 1 to 6

Figure 2:
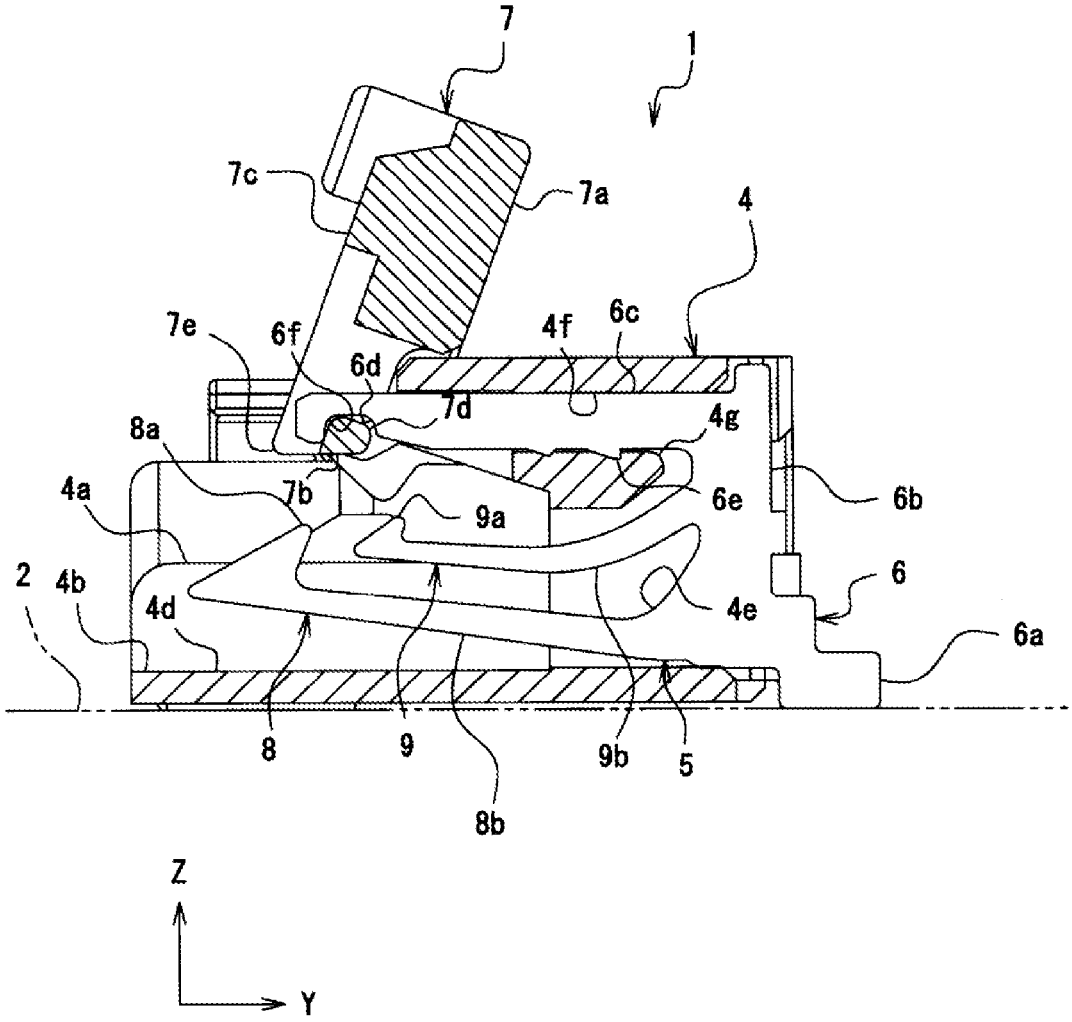
FIG. 2 is a cross-sectional view taken along a line II-II indicated by arrows in FIG. 1.

An electric connector 1 of the first embodiment according to the present invention is a connector that is mounted on the printed board 2 and that conductively connects a flat conductor 3, such as a flexible printed circuit (FPC) or a flexible flat cable (FFC), and a printed board 2 to each other. As illustrated in FIGS. 1 and 2, the electric connector 1 includes a housing 4 that receives the flat conductor 3 and terminal portions 5 that come in contact with the flat conductor 3. The electric connector 1 further includes a plurality of connector terminals 6 that are fixed to the housing 4 at equal intervals and an actuator 7 that is locked to the connector terminals 6 in a pivotal manner and that presses the flat conductor 3 against the connector terminals 6 upon pivoting of the actuator 7. Note that in the present specification, a description is given while the longitudinal direction of the electric connector 1 is referred to as an X direction, the short direction thereof is referred to as an Y direction, and a direction in which the actuator presses the flat conductor 3 is referred to as a Z direction.

(Housing)

The housing 4 is composed of an insulating resin and is formed in a substantially rectangular parallelepiped shape. The housing 4 is provided with an insertion opening 4*a* into which the flat conductor 3 is inserted and a plurality of accommodation openings 4*b* in which the connector terminals 6 are accommodated. The plurality of accommodation openings 4*b* are provided at equal intervals in the X direction with respect to each other. Furthermore, a housing portion 4*c* that houses the actuator 7 when the actuator 7 is in a closed state is provided above the accommodation openings 4*b*.

(Actuator)

The actuator 7 is composed of an insulating resin and is formed in a substantially rectangular parallelepiped shape. The actuator 7 includes an operation portion 7*a* that is operated when the actuator 7 is pivoted, a shaft portion 7*b* that is locked with respect to the connector terminals 6 in a pivotal manner, and a pressing surface 7*c* that is pressed against an upper surface 3*a* of the flat conductor 3 (a surface on the actuator 7 side). Furthermore, while the actuator 7 presses the flat conductor 3 against the terminal portions 5 by pivoting itself, the shaft portion 7*b* is positioned in the rear area of the pressing surface 7*c*.

(Connector Terminal)

The connector terminals 6 are punched terminals that are formed by punching a flat conductive metal plate. Furthermore, the connector terminals 6 each include a substrate connecting portion 6*a*, a base end 6*b*, the terminal portion 5 and a fixing piece 6*c*.

The substrate connecting portions 6*a* are connected to the printed board 2.

The base ends 6*b* each have a substantially rectangular tabular shape and are provided adjacent to a corresponding substrate connecting portion 6*a* so as to extend in the Z direction.

The terminal portions 5 each extend towards the flat-conductor-3 insertion-opening-4*a* side from a corresponding base end 6*b*. The terminal portions 5 each include a front terminal 8 and a rear terminal 9 that come in contact with an undersurface 3*b* of the flat conductor 3 (a surface on the other side with respect to the upper surface 3*a*). Even if there is a contact failure between one of the terminals and the flat conductor 3, since two terminals, namely, the front terminal 8 and the rear terminal 9, are provided, the other terminal can come in contact with the flat conductor 3.

The fixing pieces 6*c* each extend in the Y direction from the upper end side (the side opposite to the printed board 2 in the Z direction) of a corresponding base end 6*b* and are fixed to the housing 4.

The front terminals 8 each include a front contact portion 8*a* that is provided on the distal end side thereof and that comes in contact with the undersurface 3*b* of the flat conductor 3 and an elastic portion 8*b* that elastically supports the front contact portion 8*a*. The front contact portions 8*a* are disposed on the insertion opening 4*a* side in the Y direction with respect to the shaft portion 7*b* of the actuator 7 and are provided so as to face the pressing surface 7*c* of the actuator 7. The elastic portions 8*b* each extend in a cantilevered manner from the printed board 2 side of a corresponding base end 6*b* in the Z direction and are provided so as to extend from the corresponding base end 6*b* side towards the distal end side in a free state while slightly inclining towards the pressing surface 7*c* side. Therefore, a large space may be secured between the front terminals 8 and a bottom wall 4*d* provided on the printed board 2 side of the housing 4 and, accordingly, the front terminals 8 can be elastically displaced in the Z direction in a greater manner and the contact pressure can be increased such that the front terminals 8 can be made to come in contact with the undersurface 3*b* of the flat conductor 3 in a reliable manner. Moreover, in the base end 6*b* side, since a space 4*e* can be provided between the front terminals 8 and the rear terminals 9, the rear terminals 9 can be made to move into and be elastically displaced in the spaces 4*e*.

As illustrated in FIG. 2, the rear terminals 9 are provided on the distal end side and come in contact with the undersurface 3*b* of the flat conductor 3. The rear terminals 9 each include a rear contact portion 9*a* and an elastic portion 9*b* that elastically supports the rear contact portion 9*a*.

The rear contact portions 9*a* are positioned closer to the pressing surface 7*c* with respect to the front contact portions 8*a*. Accordingly, the displacement of each of the rear contact portions 9*a* can be large such that the contact pressure of each of the rear terminals 9 is increased allowing each of the rear terminals 9 to come in contact with the flat conductor 3 in a reliable manner. Furthermore, the rear contact portions 9*a* are disposed on the insertion opening 4*a* side with respect to the shaft portion 7*b* and on the rear side with respect to the pressing surface 7*c* of the actuator 7.

The elastic portions 9*b* each extend in a cantilevered manner from a substantially middle portion of the corresponding base end 6*b* in the Z direction and from a position that is on the pressing surface side in the Z direction with respect to the position of an insertion end 3*c* of the flat conductor 3 in a fitted state. Furthermore, the elastic portions 9*b* extend around so as to avoid the flat conductor 3 in the fitted state towards a bottom wall 4*d* side from the portion where the elastic portions 9*b* are each connected to the corresponding base end 6*b*; in such a state, the rear contact portions 9*a* each come in contact with the undersurface 3*b*. With the above, the length of each of the elastic portions 9*b* can be made long; accordingly, the rear terminals 9 can be bent easily resulting in rear terminals 9 that are not easily damaged.

The rear contact portions 9*a* are disposed on the rear side in the Y direction with respect to the shaft portion 7*b* and on the rear side with respect to the pressing surface 7*c* of the actuator 7. The rear contact portions 9*a* are provided on the pressing surface 7*c* side with respect to the front contact portions 8*a*;

accordingly, the displacement of each rear terminal 9 can be large. Accordingly, the contact pressure may be increased and the rear contact portions 9*a* can be made to come in contact with the flat conductor 3 in a reliable manner.

Furthermore, the front terminals 8 and the rear terminals 9 are each connected to the corresponding base end 6*b* at a portion on the rear side of the housing 4 with respect to the insertion end 3*c* of the flat conductor 3 in the fitted state. Accordingly, the lengths of the elastic portions 8*b* and 9*b* can be long and the displacement of the front terminals 8 and the rear terminals 9 can be large; accordingly, the contact pressures of the front terminals 8 and the rear terminals 9 can be increased and the front terminals 8 and the rear terminals 9 can be made to come in contact with the undersurface 3*b* of the flat conductor 3 in a reliable manner.

The fixing pieces 6*c* each include, at the distal end side thereof, a bearing concavity 6*d*, which locks the shaft portion 7*b* of the actuator 7. Furthermore, the fixing pieces 6*c* are each press-fitted into and fixed to a press-fit hole 4*f* of the housing 4. The fixing pieces 6*c* each include a lock portion 6*e* that is provided with concavities and convexities on the printed board 2 side. The lock portions 6*e* are engaged with inner walls of the press-fit holes 4*f*; accordingly, the fixing pieces 6*c* are fixed.

(Method of Applying the Electric Connector)

Figure 3:
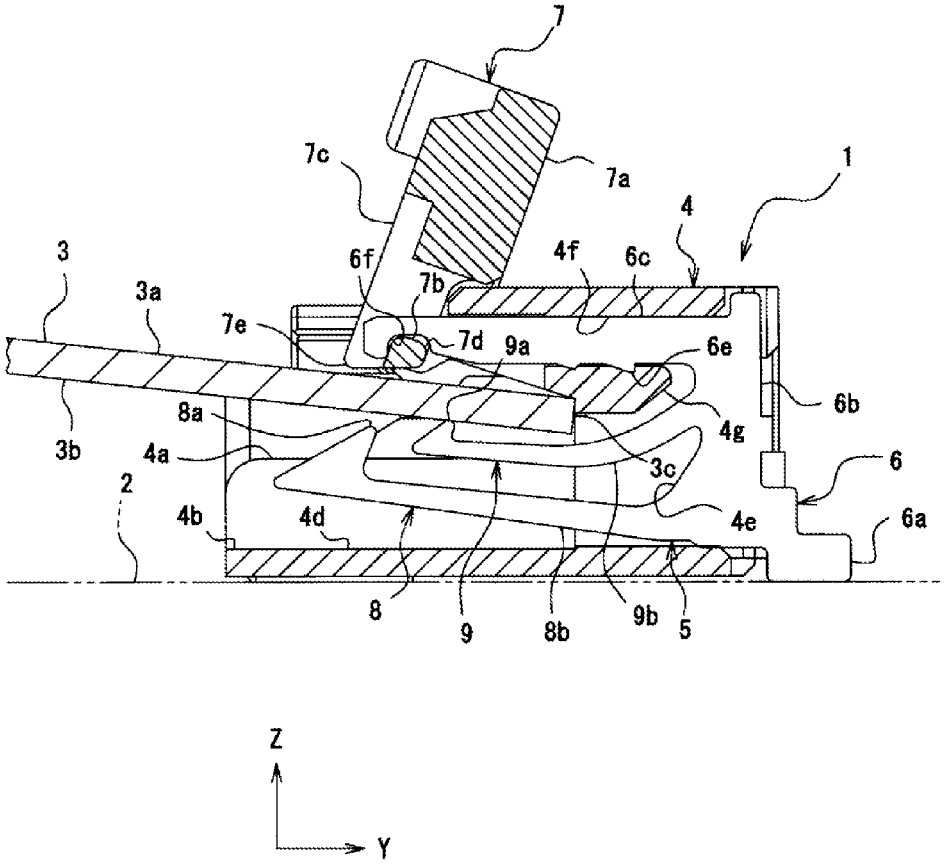
FIG. 3 is an explanatory drawing illustrating a state in which the conductor is inserted into a connector terminal that is in an open state.

A method of applying the electric connector 1 according to the present embodiment will be described now. FIG. 3 illustrates an example in which the flat conductor 3 is in contact with the rear contact portions 9*a* before the front contact portions 8*a* and in which the front contact portions 8*a* are not in contact with the flat conductor 3. However, the flat conductor 3 may softly come in contact with the front contact portions 8*a* before the rear contact portions 9*a* or may softly come in contact with the rear contact portions 9*a* at the same time with the front contact portions 8*a*.

As illustrated in FIG. 3, first, the flat conductor 3 is inserted inside the housing 4 from the insertion opening 4*a* and is abutted against a conductor receiving portion 4*g* that is provided in the accommodation openings 4*b*. The conductor receiving portion 4*g* functions as a stopper that stops the flat conductor 3 from being inserted into the rear side in the Y direction with respect to a predetermined position.

Figure 4:
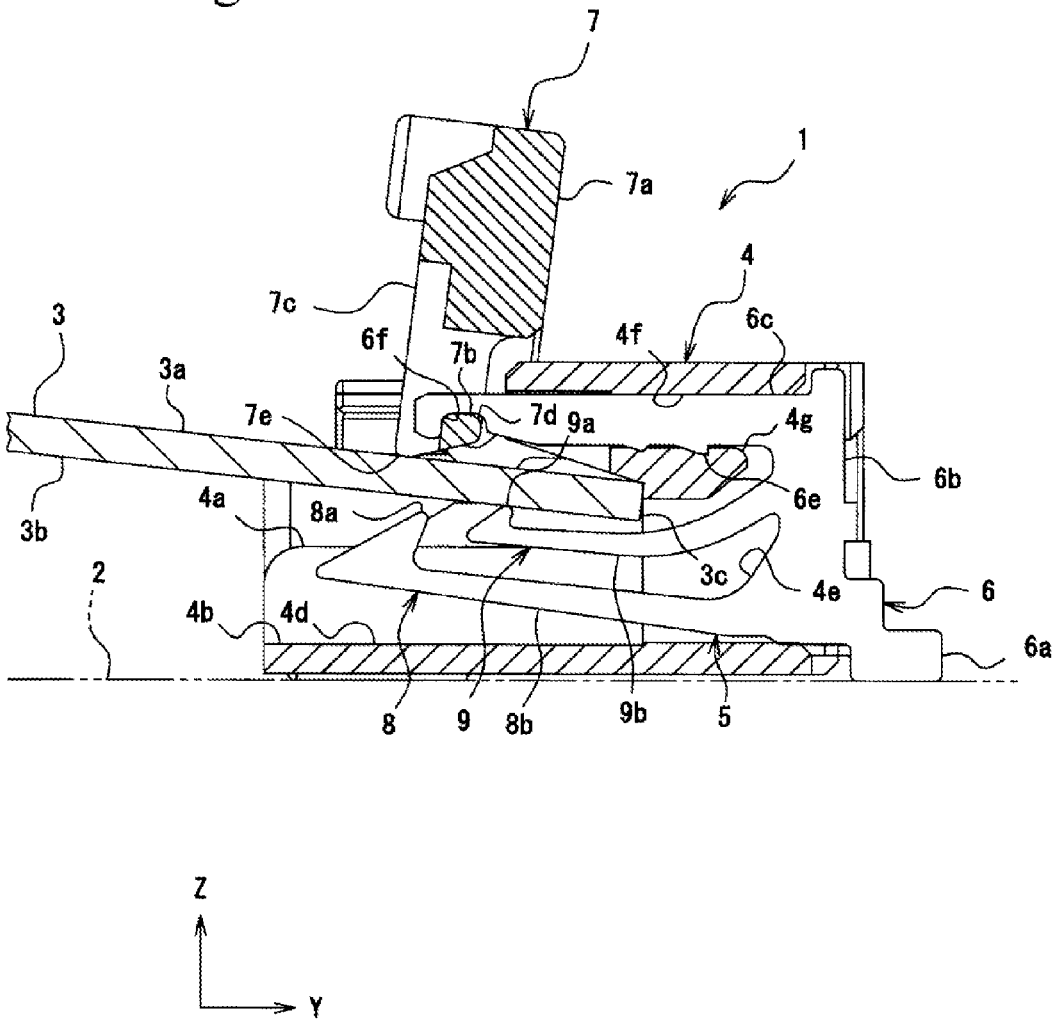
FIG. 4 is an explanatory drawing illustrating a state in which an actuator is rotated from the state in FIG. 3 such that the flat conductor and a rear contact portion are in contact with each other.

Furthermore, as illustrated in FIG. 4, when the actuator 7 that is in an open state is pivoted about the shaft portion 7*b* serving as a rotating shaft, pressing protrusions 7*e* that are provided so as to protrude out at an acute angle on the shaft portion 7*b* side of the actuator 7 are pressed against the upper surface 3*a* of the flat conductor 3. Moreover, at the same time, the rear contact portions 9*a* are pressed by the undersurface 3*b* of the flat conductor 3 and are displaced downwardly. At this time, since the flat conductor 3 is not in contact or is only softly in contact with the front contact portions 8*a*, the actuator 7 can be pivoted in the closing direction with a light force.

Figure 5:
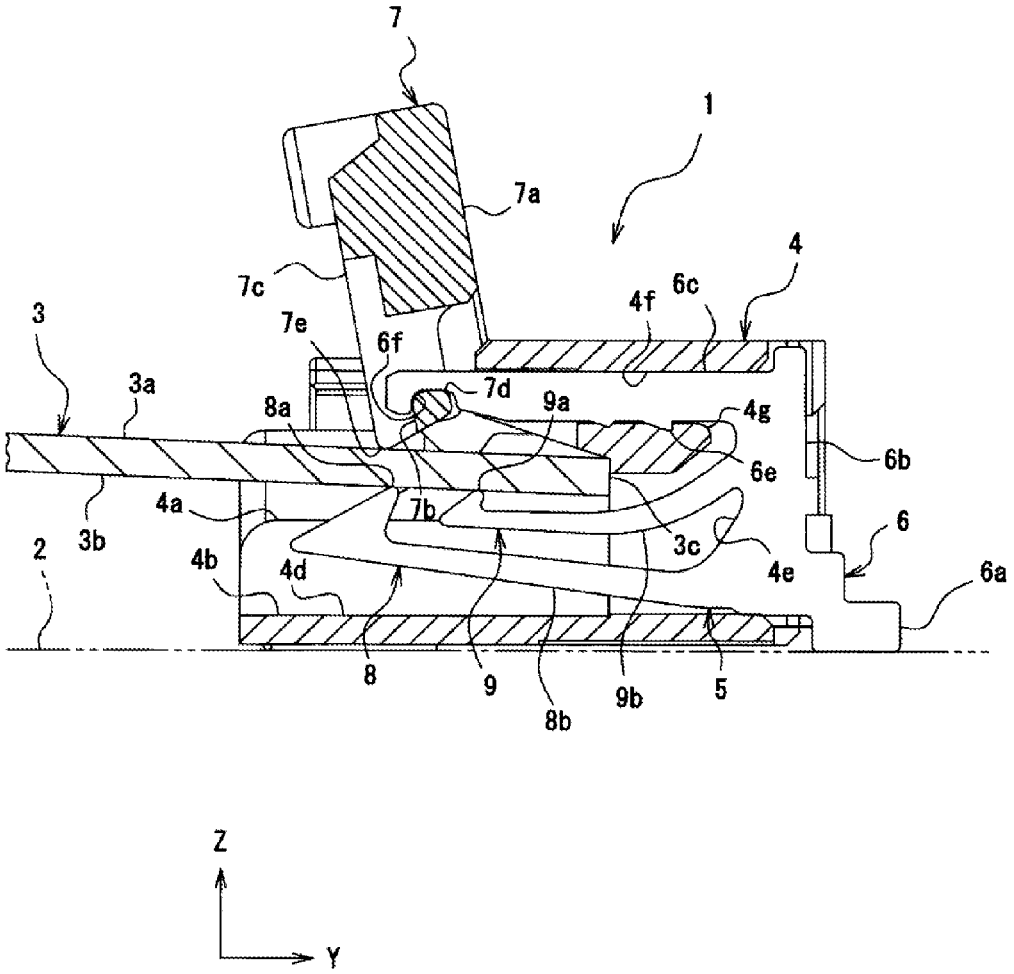
FIG. 5 is an explanatory drawing illustrating a state in which the actuator is further rotated from the state in FIG. 4 such that the flat conductor and a front contact portion are in contact with each other.

After that, when the actuator 7 is further pivoted, as illustrated in FIG. 5, the undersurface 3*b* of the flat conductor 3 comes into contact with the front contact portions 8*a* and displaces the front contact portions 8*a* downwards. At this stage, since the actuator 7 is inclined forward to the insertion opening 4*a* side, the actuator 7 can be pushed down easily in the closing direction with a light force.

Figure 6:
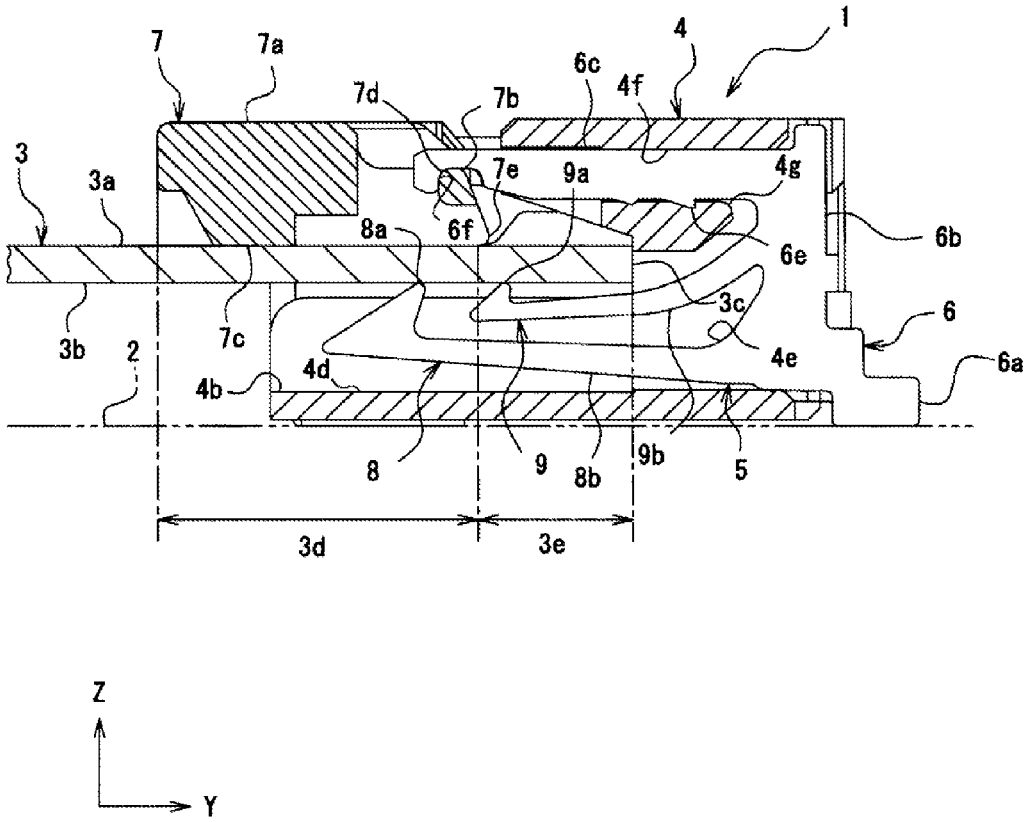
FIG. 6 is an explanatory drawing illustrating a state in which the flat conductor is fitted to the electric connector of FIG. 1.

When the actuator 7 is further pivoted, as illustrated in FIG. 6, the pressing protrusions 7*e* that are positioned on the insertion opening 4*a* side with respect to the shaft portion 7*b* are instantaneously moved over the upper surface 3*a* of the flat conductor 3 while pressing the upper surface 3*a* of the flat conductor 3 towards the undersurface 3*b* side with the momentum of the pivoting actuator 7. With the above, the pressing protrusions 7*e* are moved to the rear side with respect to the shaft portion 7*b*. In the above manner, the pressing surface 7*c* of the actuator 7 becomes parallel to the printed board 2, and the fitting process is completed.

In the above fitted state, since the pressing protrusions 7*e* that are on the rear side with respect to the shaft portion 7*b* moves to the insertion opening 4*a* side, the pressing protrusions 7*e* need to press the upper surface 3*a* in the undersurface 3*b* direction and move over the upper surface 3*a*. Accordingly, even if there is pressure applied to the actuator 7 or the flat conductor 3 in the opening direction, pivoting of the actuator 7 can be suppressed and the fitted flat conductor 3 and electric connector 1 can be prevented from being detached.

The front contact portions 8*a* are disposed so as to face the pressing surface 7*c* of the flat conductor 3 in the fitted state and hold a press receiving portion 3*d* of the flat conductor 3, which is in contact with the pressing surface 7*c*, between themselves and the pressing surface 7*c* such that the printed board 2 is maintained in a parallel state.

Conversely, the rear contact portions 9*a* are disposed on the rear side with respect to the press receiving portion 3*d* and are in contact from the lower side with a non-press-receiving portion 3*e* of the flat conductor 3 that does not come in contact with the pressing surface 7*c*. Accordingly, since the pressing surface 7*c* of the actuator 7 does not directly receive the pressing force of the rear terminals 9, the actuator 7 can be prevented from being pivoted in both the closing direction and the opening direction.

Furthermore, in the electric connector 1 of the present embodiment, the base ends of the elastic portions 8*b* and 9*b* are provided on the rear side of the housing 4 and the front contact portions 8*a* and the rear contact portions 9*a* are provided on the insertion opening 4*a* side. Accordingly, the flat conductor 3 can be brought in contact on the insertion opening 4*a* side of the housing 4 and, as a result, the flat conductor 3 can be further prevented from easily tilting in the closing direction of the actuator 7.

The contact pressures of the rear terminals 9 are set higher than the contact pressures of the front terminals 8. If the contact pressures of the front terminals 8 are set higher than the contact pressures of the rear terminals 9, the operator may feel a stronger reactive force in the hands when the actuator 7 is pivoted and when the undersurface 3*b* of the flat conductor 3 comes in contact with the front terminals 8 after the rear terminals 9 are displaced. Then, the operator may erroneously perceive that the fitting process has been completed and may stop the fitting work.

Therefore, in the electric connector 1 of the present embodiment, the contact pressures of the rear terminals 9 are set higher than the contact pressures of the front terminals 8. By doing so, the front terminals 8 can be displaced instantaneously with the momentum created by pivoting the actuator 7 and by displacing the rear terminals 9. Accordingly, the undersurface 3*b* of the flat conductor 3 can be reliably brought in contact with the front terminals 8 and the rear terminals 9.

The section of the shaft portion 7*b* does not have a circular shape but has a substantially trapezoid shape and an edge portion 7*d* is formed so as to have a rounded shape. Furthermore, the bearing concavity 6*d* is also formed in a substantially trapezoid and rounded shape so as to correspond to the sectional shape of the shaft portion 7*b*. Accordingly, during pivoting of the actuator 7, the pivoting of the actuator 7 is stopped when a state in which the edge portion 7*d* of the shaft portion 7*b* matches the edge portion 6*f* of the bearing concavity 6*d* is reached. With the above, the pivoting of the actuator 7 in the closing direction can be suppressed in a further reliable manner and a state in which the flat conductor 3 is parallel to the printed board 2 can be maintained.

As described above, the electric connector 1 and the connector terminals 6 according to the present embodiment can, without exerting any pressing force that biases the actuator 7 in the closing direction, make it difficult for the flat conductor 3 that is fitted into the electric connector 1 to be released from the electric connector 1.

Modification of the First Embodiment

The electric connector 1 of the first embodiment illustrates an example in which the pressing surface 7*c* of the actuator 7 is fixed in a parallel manner to the printed board 2. Conversely, the second embodiment may be an electric connector 10 in which the pressing surface 7*c* is not parallel to the printed board 2 but is inclined upwards from the rear side of the housing 4 towards the insertion opening 4*a* side. With such a configuration, the flat conductor 3 can be inclined upwards in a similar manner from the rear side of the housing 4 to the insertion opening 4*a* side; accordingly, the flat conductor 3 can be prevented from coming in contact with the printed board 2 in a more reliable manner.

Other Embodiments

Figure 7:
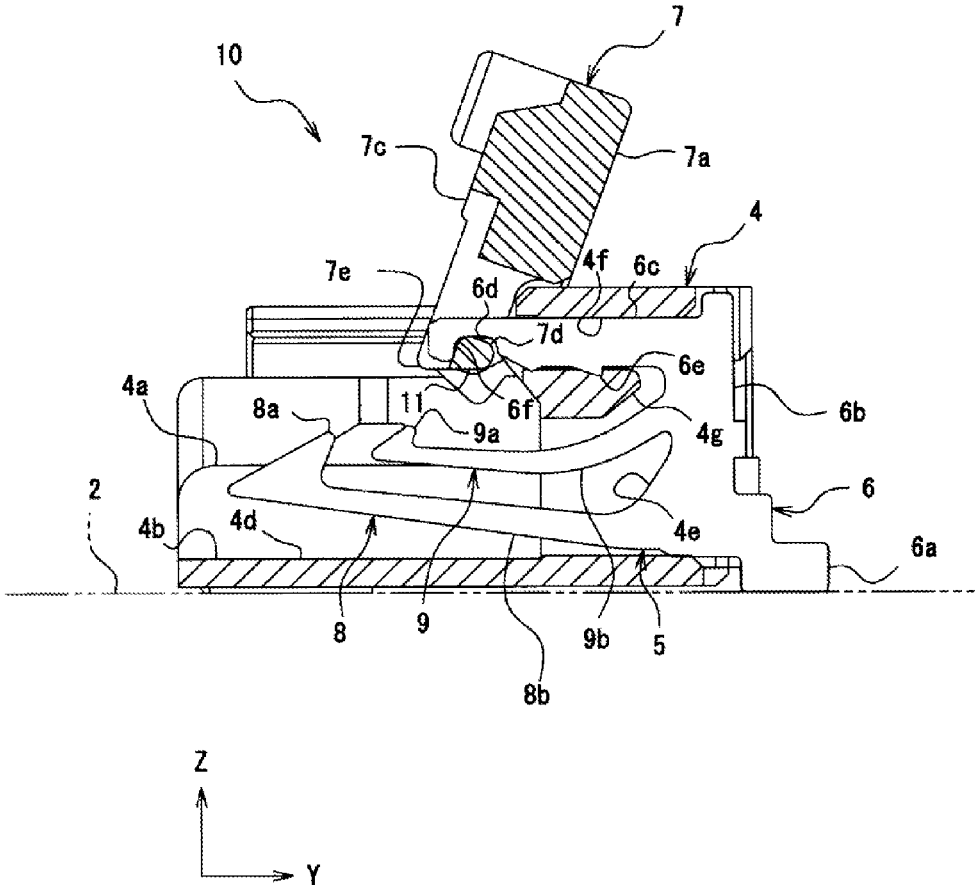
FIG. 7 is a cross-sectional view of an electric connector of another embodiment that corresponds to FIG. 2.
Figure 8:
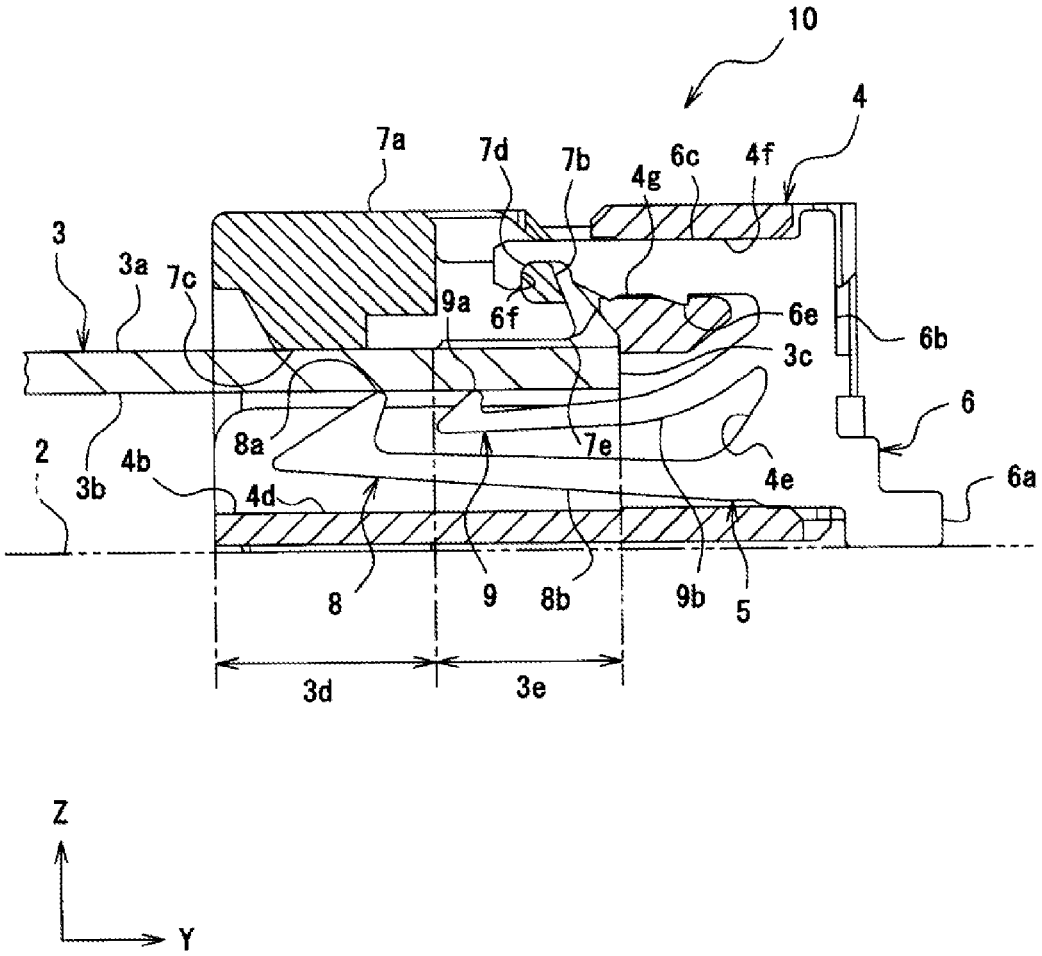
FIG. 8 is an explanatory drawing illustrating a state in which the flat conductor is fitted to the electric connector of FIG. 7.

FIGS. 7 and 8

The first embodiment illustrates an example in which the shaft portion 7*b* of the actuator 7 is provided in the area of the pressing surface 7*c* and in which the rear terminals 9 are provided on the rear side of the housing 4 with respect to the shaft portion 7*b* of the actuator 7. However, as illustrated in FIGS. 7 and 8, the electric connector may be an electric connector 10 in which a shaft portion 11 is provided on the rear side with respect to the pressing surface 7*c*. By providing the shaft portion 7*b* in such a manner as in the above case, the distal end side of the actuator 7 can be prevented from extending out on the insertion opening 4*a* side in the Y direction. With such a configuration, the electric connector 10 that is compact in the Y direction can be fabricated. Furthermore, in the electric connector 10, the rear terminals 9 may be disposed on the insertion opening 4*a* side with respect to the shaft portion 11. With such a configuration, the actuator 7 can maintain the fitting state with the flat conductor 3 without receiving any pressing force from the rear terminals 9 in both the closing direction and the opening direction.

What is claimed is:

1. An electric connector, comprising:

a housing including an insertion opening for a flat conductor having an upper surface and an undersurface;

a connector terminal that is conductively connected to the flat conductor;

an actuator including a pressing surface that presses the upper surface of the flat conductor against the connector terminal by a pivoting motion and a shaft portion that serves as a central axis of the pivoting motion, wherein the connector terminal includes a terminal portion that comes in contact with the flat conductor, and a base end that supports the terminal portion at a position on a rear side of the housing in a short direction, the terminal portion includes a front terminal that includes a front contact portion that is provided on an insertion opening side with respect to the shaft portion and at a position facing the pressing surface, and a rear terminal that includes a rear contact portion that is provided on the rear side of the housing in the short direction with respect to the pressing surface and at a position on the upper side of the housing with respect to the front contact portion, and the rear terminal is connected to the base end at a position higher than the undersurface at an insertion end of the flat conductor in a fitted state.

2. The electric connector according to claim 1, wherein the rear terminal is connected to the base end at a position on the rear side of the housing in the short direction with respect to the insertion end of the flat conductor in the fitted state.

3. The electric connector according to claim 1, wherein the front terminal is connected to the base end at a position on the rear side of the housing in the short direction with respect to the insertion end of the flat conductor in the fitted state.

4. The electric connector according to claim 1, wherein the front terminal is inclined from the base end side towards a distal end side so as to approach the pressing surface.

5. The electric connector according to claim 1, wherein the pressing surface is provided in a parallel manner with respect to a printed board on which the housing is mounted when the flat conductor is in the fitted state.

6. The electric connector according to claim 1, wherein the pressing surface is provided so as to incline upward from the rear side of the housing in the short direction towards the insertion opening side when the flat conductor is in the fitted state.

7. The electric connector according to claim 1, wherein the shaft portion is provided on the rear side of the housing in the short direction with respect to the pressing surface.

8. The electric connector according to claim 1, wherein the front terminal further includes an elastic portion that elastically supports the front contact portion, the elastic portion is connected to the base end at a position on a lower side of housing with respect to the insertion end of the flat conductor in the fitted state while the elastic portion slightly inclining up toward the front contact portion.

* * * * *